United States Patent [19]

Smith et al.

[11] Patent Number: 4,562,966

[45] Date of Patent: Jan. 7, 1986

[54] ATOMIZER

[75] Inventors: Donald A. Smith, Haddam; Richard C. LaFlesh, Suffield, both of Conn.

[73] Assignee: Canadian Patents and Development Limited/Societe Canadienne des Brevets et d'Exploitation Limitee, Ottawa, Canada

[21] Appl. No.: 518,551

[22] Filed: Jul. 29, 1983

[51] Int. Cl.[4] ..... B05B 7/04

[52] U.S. Cl. ..... 239/433; 239/599

[58] Field of Search ..... 239/8, 418, 433, 597, 239/599, 398, 589, 601

[56] References Cited

U.S. PATENT DOCUMENTS 140,465 7/1873 Burns ..... 239/433

4,169,556 10/1979 Muller ..... 239/597 X

*Primary Examiner*—Jeffrey V. Nase

*Assistant Examiner*—James R. Moon, Jr.

*Attorney, Agent, or Firm*—Troxell K. Snyder

[57] ABSTRACT

An atomizer (14) for producing a finely dispersed spray (16) of a solid-liquid slurry (18) includes a mixing body (22) having an internal mixing chamber (28) and a spray outlet passage (30). The flow cross-section of the mixing chamber (28) is elongated in shape, with an atomizing medium inlet passage (24) for injecting an atomizing medium (20) into the mixing chamber (28) co-linearly with the spray outlet passage (30). The slurry inlet passage (26) injects the slurry (18) into the mixing chamber (28) at an angle (32) oblique to the flow of atomizing medium and perpendicular to the mixing chamber flow cross-section elongation.

3 Claims, 4 Drawing Figures

ATOMIZER

FIELD OF THE INVENTION

The present invention relates to an atomizer for producing a dispersed spray of substantially liquid material and, more particularly, to a twin fluid atomizer wherein an atomizing medium is mixed with the substantially liquid material within the atomizer for augmenting the dispersion of the liquid material as a spray.

BACKGROUND OF THE INVENTION

Atomizers or spray nozzles are well known in those technologies in which it is desired to disperse or spray a liquid material as a cloud of small droplets. The liquid to be dispersed commonly enters the atomizer under pressure, with the configuration of the atomizer designed to utilize the pressure head as the energy source for causing the dispersal of the liquid.

For viscous liquids the amount of energy required to break the liquid stream into small droplets is so great as to preclude the use of liquid pressure alone as a source. In this situation a dual fluid atomizer is commonly employed wherein an atomizing medium, usually a pressurized gas such as steam or air, is commingled with the liquid material within the atomizer and the mixture forced out under pressure. The expansion of the atomizing medium upon exiting the atomizer, along with the initial breaking up of the liquid material within the atomizer, provides the necessary energy to provide a good dispersion of the liquid material as a cloud of very fine droplets.

One common situation wherein a viscous material must be sprayed out as a cloud of fine droplets is in a combustion furnace utilizing heavy oil as fuel. The oil must be dispersed within the furnace in order to permit good mixing with the combustion air resulting in efficient and rapid combustion of the heavy oil. Such atomizers are common within the power generation industry and have been refined so as to perform satisfactorily over a wide range of sizes and fuel types.

Recently, interest in substantially liquid fuels consisting of a slurry of finely divided solids, such as coal, suspended in a carrier liquid, such as water, has been on the rise. Coal-water slurries, as these fuels are known, offer a considerable economic advantage over petroleum based fuels on a cost-per-BTU basis and may be applicable to a great number of situations in which the use of coal alone would be impractical.

While the technology exists to manufacture coal-water slurries combustible within a furnace, the development of an effective and reliable burner for these fuels has remained a stumbling block. One key element of any successful slurry fuel burner is an atomizer which is able to fragment the slurry fuel into readily combustible droplets or particles. The size, velocity and trajectory of these fuel droplets are functions of both the atomizer's design and the local aerodynamics, and directly effect overall burner performance in terms of flame length, stability and carbon burnout.

Two properties of coal-water slurry fuels have been identified as having the potential to cause problems in achieving effective atomization. These are the erosive nature of the slurry upon internal atomizer flow passages and the relatively high viscosity of coal-water slurry fuels relative to conventional petroleum products. The dual fluid atomizer discussed above has been shown to be effective for heavy oil and therefor seems a likely candidate for use with coal-water slurry fuels. Additionally, due to the simple geometry of the dual fluid atomizer design which has no tortuous paths, the atomizer may be easily fabricated with erosion resistant materials.

Attempts to design coal-water slurry atomizers based upon existing dual fluid atomizer technology has produced a number of workable, although compromise, designs. The peculiar nature of the coal-water slurry fuel has often restricted the designer from fully utilizing the inherent features of the dual fluid atomizer. By way of example, one method of increasing the dispersion of a liquid medium in a dual fluid atomizer is to increase the momentum of the liquid material as it is commingled with the atomizing medium. For a burner of fixed thermal output, the only manner of increasing the momentum of the liquid material is to restrict the liquid inlet passage. Although coal-water slurries generally behave much as a liquid, the slurry is still composed of particles suspended in a liquid carrier. Should the passage be restricted to a very small diameter, the larger particles present in the slurry may block the inlet passage and plug the atomizer. It is a good design practice to restrict the slurry passage diameter to no less than 10 times the diameter of the largest particle present in the slurry. Additionally, the coal-water slurry supply pumps generally available at this time are restricted to moderate outlet pressures in the range of 100 to 200 PSI (690 to 1380 kPa). This limits the total slurry pressure drop allowable across the atomizer and may as a result limit the mass flow through an otherwise adequately sized slurry passage. Higher pressure slurry pumps, while available from a limited number of manufacturers, are very costly.

Given these restrictions on the coal-water slurry supply pressure and inlet passage size, the remaining alternative left to the designer is to alter the momentum of the atomizing medium. By increasing the mass flow and/or decreasing the atomizing medium inlet passage, the designer can improve dispersion of the coal-water slurry at the cost of increased consumption of the atomizing medium and increased pumping costs resulting from the elevated pressure and flow.

Such designs, although workable, are still restricted in terms of performance. There is clearly a need for an efficient, low power consumption atomizer for coal-water slurry fuels or other viscous liquids that is resistant to plugging and able to deliver a spray of finely divided droplets with a minimum amount of atomizing medium for a given liquid flow.

SUMMARY OF THE INVENTION

In the preferred embodiment of the present invention, a mixing body is provided with an internal mixing chamber for commingling a liquid-solid slurry and an atomizing medium. The commingled slurry and medium exit the mixing chamber and the mixing body under pressure through a spray passage, forming a dispersed cloud of finely divided droplets.

In the preferred embodiment, the mixing chamber is an extension of the spray passage and both have an elongated flow cross-section. The atomizing medium enters the mixing chamber through a first inlet passage disposed in the mixing body colinearly with the spray passage. The liquid-solid slurry enters the stream of atomizing medium in the mixing chamber through a second inlet passage disposed perpendicularly to the elongation of the flow cross-section and obliquely to the flow direction of the atomizing medium. The commingled slurry and medium flow down the spray passage and exit the mixing body as a spray.

As a result of the particular arrangement of the inlet and spray passages and the shape of the mixing chamber, the present invention provides a spray nozzle able to produce a spray of finely divided droplets of liquid slurry while consuming less atomizing medium at lower supply pressure than spray atomizers known in the prior art. Moreover, it is a feature of the present invention to provide an effective atomizer which is less prone to plugging of the internal flow passages.

BRIEF DESCRIPTION OF THE DRAWING FIGURES

Figure 4:
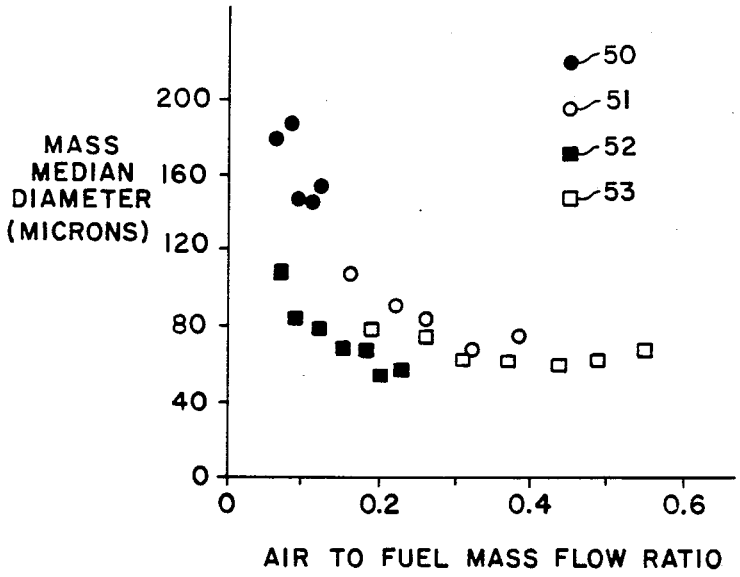

FIG. 4 compares the performance of the atomizer according to the present invention with the performance of a prior art atomizer.

DESCRIPTION OF THE PREFERRED EMBODIMENT

Figure 1:
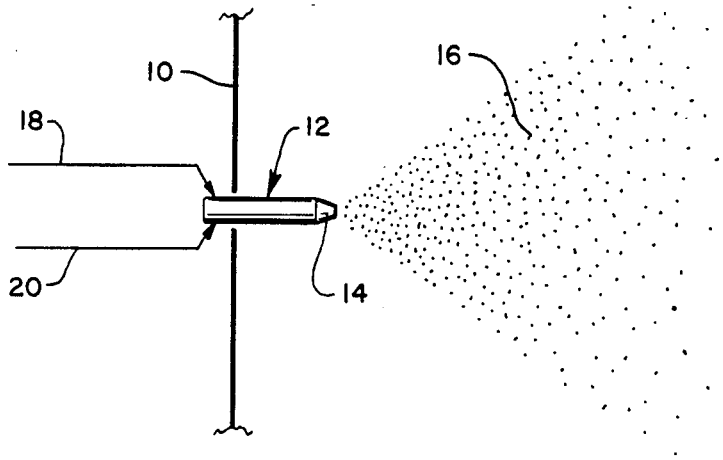
FIG. 1 shows an atomizer dispersing a liquid into a spray of fine droplets.

FIG. 1 shows a spray distribution means 12 disposed in the wall of a chamber 10 for producing a uniform spray pattern 16 of a liquid 18. For very viscous liquids 18 it is common to use a dual fluid atomizer 14 as part of the distribution means 12. Such an atomizer 14 requires an atomizing medium 20 which is usually a gaseous fluid such as steam or air. The goal of such spray distribution means 12 is to produce a spray pattern 16 of uniform mass distribution and individual droplet size. For most applications wherein such a distribution is desired, it is also usually advantageous to produce droplets within the spray pattern 16 of very small size, particularly when the liquid 18 is to be contacted with a gas or other material within the chamber 10.

One such situation occurs in the combustion of a heavy liquid fuel for the production of heat energy. Here the small droplet size is desirable to promote quick and complete reaction of the liquid fuel and the oxidizing gas (not shown) within the furnace chamber 10. Dual fluid atomizers 14 for use with heavy petroleum liquid fuels 18 are known in the art and are currently in use in many large electric generating plants.

Coal-water slurries are also well known and generally consist of a water carrier in which finely comminuted coal is present in suspension. Depending upon the particular type of slurry, the solids portion of the total slurry mass may be 65% or more. Such slurries exhibit overall behavior similar to that of a pure liquid in that they may be poured, stored in tanks, and transported through conduits. For certain other processes, such as atomization into a cloud of fine droplets, this similarity ends and coal-water slurries exhibit a number of unique and potentially troublesome properties.

First among these unique properties results from the presence of solid particles within the slurry. These particles become of importance when it is desired to force the slurry through a conduit or passageway in which the diameter of the flow passage becomes of the same order of magnitude as that of the larger solid particles present within the slurry. In such a situation a liquid-solid slurry may have a tendency to plug up the flow passage and restrict or stop the flow of slurry therethrough. As most liquid-solid slurries are prepared by comminuting the solid as finely as is practicable, an effective solution to this problem is to refrain from using slurry. passages smaller than at least 10 times the diameter of the largest solid particle expected in the slurry. For slurry atomizers designed for low mass throughput of liquid-solid slurries, this lower limit on slurry passage sizing results in a lowering of the velocity, and hence the momentum, of the slurry 18 entering the mixing chamber 28. Such reduction has generally proved, until the present invention, to have resulted in a degradation of atomizer performance.

Second is the abrasive nature of the solid particles in general, and of coal particles in particular. The result of this property is seen primarily as increased wear of the slurry-handling components, particularly those in which the slurry flow is re-directed at high velocity. The atomizer of the present invention, being preferably fabricated of wear-resistant materials such as tungsten carbide, is configured to minimize internal changes of slurry flow direction and to permit reduced slurry velocities in the slurry inlet passages.

Third is the current state of the art of coal-water slurry supply pump. Effective designs of such pumps are limited in number and most pumps commercially available at this time supply the slurry at moderate pressures on the order of 100 to 200 psi (690 to 1380 kPa). This pressure limitation, along with the high viscosity of liquid-solid slurries, reduces the benefit obtainable even if the two preceding obstacles are overcome. Any attempt to force a viscous slurry to flow quickly through a small flow passage may result in a slurry pressure requirement unobtainable with currently available slurry supply pumps. This problem is also addressed by the present invention in which effective atomization and distribution is obtained without excessive slurry supply pressure.

Figure 2:
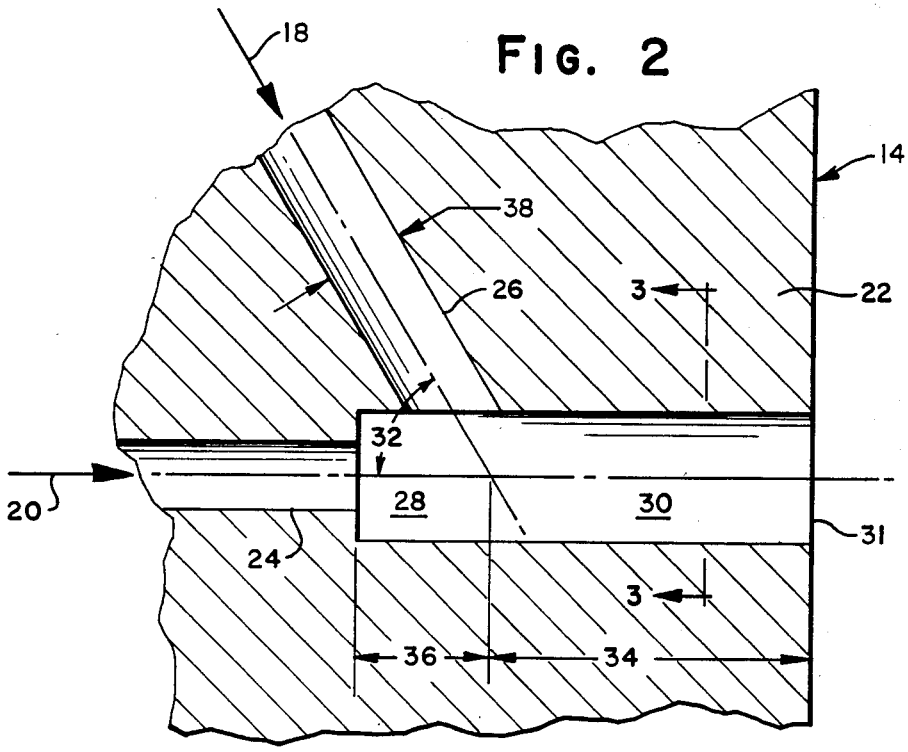
FIG. 2 is a longitudinal cross-section of the atomizer according to the present invention.

FIG. 2 shows a cross-sectional view of the atomizer according to the present invention taken longitudinally along the central axis. The mixing chamber 28 is shown as a void disposed within a solid mixing body 22. In the preferred embodiment, the atomizing medium 20 enters the mixing chamber 28 through a first inlet flow passage 24. The liquid-solid slurry 18 is shown as entering the mixing chamber 28 through a second inlet flow passage 26 which intersects the atomizer medium flow path at an oblique angle 32. The medium 20 and the slurry 18 are commingled within the mixing chamber 28 and exit the nozzle body 22 through the spray passage 30. By introducing the slurry 18 obliquely into the flow path of the atomizing medium 20 within the mixing chamber 28, there thus exists a transverse momentum component to the slurry 18 for the purpose of augmenting the commingling of the slurry 18 and the medium 20 within the mixing chamber 28.

Figure 3:
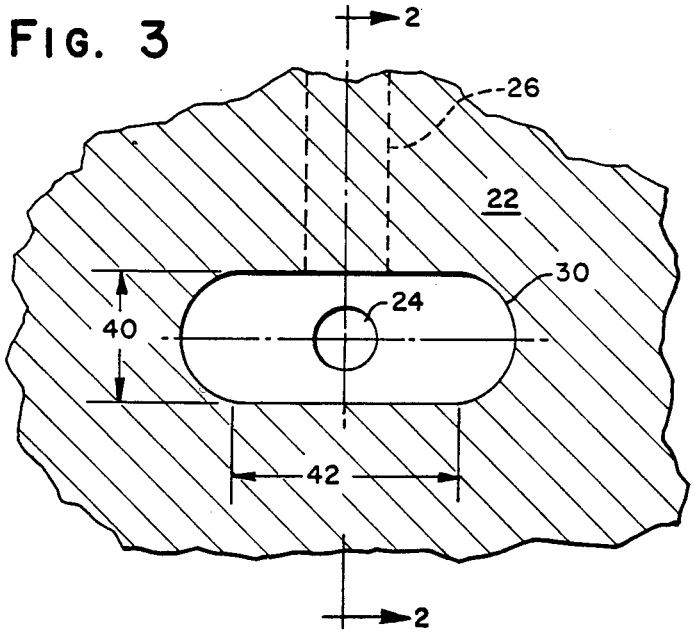
FIG. 3 is an axial cross-sectional view of the atomizer according to the present invention.

FIG. 3 shows the indicated cross-section taken transversely to the centerline of the central passage 30. The cross-sectional flow area of the mixing chamber 28 and flow passage 30 as illustrated in FIG. 3 are of interest and illustrate one of the salient features of the atomizer according to the present invention. The flow cross-section of the mixing chamber 28 and the spray passage 30 are elongated in shape rather than circular as in the prior art. It is this "squashed" cross-section which enables the atomizer according to the present invention to produce a uniform spray of finely divided droplets without excessive consumption of atomizing medium and without the requirement of very high slurry momentum entering the mixing chamber 28.

The experimental results pictured in FIG. 4 show the effectiveness of the atomizer according to the present invention in comparison to a prior art atomizer. The graph in FIG. 4 charts the mass median diameter in microns against the air to fuel ratio for two dual fluid atomizers using 90 PSI air as the atomizing medium and a liquid-solid slurry composed of water and coal particles. The round data points 50, 51 represent the performance of a prior art atomizer having circular cross-section flow passages. The square data points 52, 53 represent the performance of the atomizer according to the present invention having a squashed flow cross-section in the mixing chamber.

In general, the better performance is obtained the closer the data points approach the intersection of the two axes, wherein a very small median diameter of the droplets is obtained through the use of a minimum amount of atomizing air. As can be seen in FIG. 4, the prior art atomizer under full load conditions generates droplets having median diameters (represented by data points 50) on the order of 140 to 180 microns when the air to fuel mass flow ratio is approx1mately on the order of 0.1.

By comparison, the atomizer according to the present invention generates droplets having median diameters 52 of approximately 110 to 70 microns at the same air to fuel mass flow ratio of 0.1. The significance of this difference will not be lost on the skilled reader. By cutting down the median droplet diameter under conditions of reduced air to fuel ratio, an atomizer according to the present invention produces a much more readily combustible spray of coal-water slurry than does the prior art atomizer, which was incidentally optimized for coal-water dispersal.

The open data points 51, 53 represent the performance of both atomizers under conditions of 50 percent design fuel mass flow and show similar performance for air to fuel ratios of 0.3 and higher.

Although the squashed or elongated flow cross-section is shown in the preferred embodiment as being present in both the spray passage 30 and the mixing chamber 28, it is the mixing chamber in which this configuration acts to produce the beneficial results shown in FIG. 4. By injecting the liquid solid slurry 18 into the flow established by the atomizing medium 20 at a right angle to the elongation of the mixing chamber 28, the atomizer according to the present invention provides a shortened distance through which the slurry must travel to penetrate the entire atomizer flow stream. Prior art atomizers with circular flow cross-sections in the mixing chambers have a much greater distance through which the slurry must travel in order to completely penetrate the atomizing medium flow stream and result in a complete commingling of the two fluids. The atomizer according to the present invention is thus able to effect a complete commingling of the liquid-solid slurry and the atomizing medium within the mixing chamher 28 under conditions of reduced pressure and momentum than those present within prior art atomizers of equivalent performance.

As discussed above, this sizing of the atomizer spray passages is dependent upon a number of application-specific variables such as liquid viscosity, design mass flow, operating pressure and other properties. It has been found through experimentation that the velocity of the commingled slurry and medium in the spray outlet passage 30 should preferably be at least sonic, and that certain empirical relationships between the dimensions of the passages and mixing chamber 28 must be maintained for optimum atomization of coal-water slurries. Referring to FIG. 2, the ratio of spray outlet passage lengths 34 (termed $L_o$ in the following equation) to the mixing chamber flow length 36 (termed also $L_m$) is approximately 2.3.

In addition, an optimum atomizer design according to the present invention requires maintaining the ratio of the spray outlet passage length 34 to the total slurry hydraulic diameter (also termed $D_{tot}$) in the range of approximately 4.65 to 6.25 inclusive. The total slurry hydraulic diameter can be calculated by summing the flow area of the slurry inlet passage 26 and the rectangular mixing chamber free-flow area and determining the diameter of a circular flow passage of equivalent area. The parameters, along with the drawing reference numerals, may be summarized as follows:

$$L_o/L_m=2.3$$

$$D_{tot}=(4[(\pi D_f^2/4)+(H\times W)]/\pi)^{\frac{1}{2}}$$

$$4.65\leqq L_o/D_{tot}\leqq 6.25$$

wherein:

$L_o$=spray outlet passage length 34

$L_m$=mixing chamber flow length 36

$D_f$=slurry inlet passage diameter 38

W=width of mixing chamber in direction of elongation, exclusive of any rounded portion, 42

$D_{tot}$=total slurry hydraulic diameter, defined above

H=height of mixing chamber, perpendicular to direction of elongation, 40

While the exact magnitude of the constants in the above equations may vary for substantially liquid materials other than coal-water slurries, it is expected that the predictive value of these relationships be valuable in the design of squashed atomizers for viscous liquids other than coal-water slurries, and it should therefore be understood that the numerical values presented herein are to be taken in an illustrative sense to fulfill the applicants' duty of full disclosure, and should therefore not unnecessarily limit the scope of this disclosure.

Moreover, that this configuration need not be restricted to only atomizers for liquid-solid slurries, but will also provide advantageous results when used with other viscous fluids for which excellent dispersal as a spray of finely divided droplets is desired, should be apparent to even the most casual reader and is hereby reaffirmed. Other embodiments, not listed herein, will likewise be apparent to a reader skilled in the art upon review of the foregoing specification and inspection of the appended claims and drawing figures.

We claim:

1. An atomizer for producing a finely dispersed spray of a substantially liquid fuel, said atomizer having disposed therein:

an internal mixing chamber of elongated flow cross-section for receiving and completely commingling the substantially liquid fuel and a gaseous atomizing medium;

a spray outlet passage having an elongated flow cross-section corresponding to the flow cross-section of the mixing chamber and in fluid communication therewith, said spray outlet passage opening at the surface of the atomizer for discharging the commingled liquid fuel and atomizing medium therefrom as a finely dispersed spray, the spray outlet passage and mixing chamber further defining a spray outlet flow length, a mixing chamber flow length, and a total slurry hydraulic diameter such that the ratio of the spray outlet passage flow length to the mixing chamber flow length is approximately 2.3 and the ratio of the spray outlet passage flow length to the total slurry hydraulic diameter has a value between approximately 4.65 and 6.25, inclusive;

an atomizing medium inlet passage, colinear with the spray outlet passage, for conducting the atomizing medium into the mixing chamber; and a slurry inlet passage opening into the mixing chamber at an oblique angle with respect to the atomizing medium inlet passage, for conducting the substantially liquid fuel into the mixing chamber.

2. The mixing body of claim 1, wherein the liquid fuel comprises a quantity of solid material held in suspension within a liquid carrier.

3. The mixing body as recited in claim 2, wherein the solid is coal and the liquid carrier is water.

* * * * *